US005855502A

United States Patent [19]

Truchsess

[11] Patent Number: 5,855,502

[45] Date of Patent: Jan. 5, 1999

[54] ANIMATED CHARACTERS UTILIZING FACE UNIT MECHANISM AND CONTROL SYSTEM

[75] Inventor: Joseph F. Truchsess, Ridgefield, Conn.

[73] Assignee: Pragmatic Designs Inc., Port Chester, N.Y.

[21] Appl. No.: 801,198

[22] Filed: Feb. 18, 1997

[51] Int. Cl.[6] ..... A63H 3/28; A63H 3/40

[52] U.S. Cl. ..... 446/301; 446/343

[58] Field of Search ..... 446/298, 299, 446/300, 301, 302, 303, 395, 391, 392, 337, 343

[56] References Cited

U.S. PATENT DOCUMENTS

| | | | |
|---|---|---|---|
| 3,364,618 | 1/1968 | Ryan | 446/299 |
| 3,421,254 | 1/1969 | Ryan et al. | 446/299 |
| 4,579,543 | 4/1986 | Renger et al. | 446/379 X |
| 4,665,640 | 5/1987 | Forsse | 446/301 X |
| 4,775,352 | 10/1988 | Curran et al. | 446/301 |
| 4,805,328 | 2/1989 | Mirahem | 446/298 X |
| 4,808,142 | 2/1989 | Berliner | 446/301 |
| 4,843,497 | 6/1989 | Leyden | 446/301 |

*Primary Examiner*—Klen T. Nguyen
*Assistant Examiner*—Jeffrey D. Carlson
*Attorney, Agent, or Firm*—Martin Smolowitz

[57] ABSTRACT

An animated character having a face unit provided in a support structure upper body portion so as to resemble a singing tree. The face unit includes a face member and mechanism which consists of two pivotable eye elements and a lower lip element each separately driven by an electric motor through a gear and linkage system. A control circuit unit and a speaker are provided in the support structure, so that the eyes and mouth elements of the face unit are moved by the face mechanism in synchronism with singing and/or speaking sounds produced by the control circuit system and speaker mounted in the support structure.

11 Claims, 5 Drawing Sheets

B1
76
MOTOR DRIVER
Q8
C12-14
R25
R21
M1
74
Q6
R20
R19
R18
LEVEL DETECTOR
D1
C11
AMPLIFIER DETECTOR
Q5
R16
R15
C10
R17
LOW-PASS FILTER
R14
C9
R13
C8
R12
C7
SPKR 72
Q4
C6
R8
AMPLIFIER
73
71
STA
AUD
VDD
U1
VSS
OSC
R7
70
STORAGE/PLAYBACK

ANIMATED CHARACTERS UTILIZING FACE UNIT MECHANISM AND CONTROL SYSTEM

BACKGROUND OF INVENTION

This invention pertains to animated characters utilizing an improved face unit mechanism and control system which synchronizes facial movements with sounds produced by the character. It pertains particularly to a face unit mechanism and integrated control system for moving eyes and mouth of the animated character in synchronism with singing or speaking sounds emitted by a speaker in the character body.

Various animated characters having movable arm and mouth parts have been developed and are disclosed by prior art patents. For example, U.S. Pat. No. 3,230,665 to Ryan discloses an animated doll toy having movable eyes and lips actuated by elongated rods from a geared drive motor and having sounds produced by a phonograph unit. U.S. Pat. No. 3,364,618 and U.S. Pat. No. 3,421,254 to Ryan et al also disclose similar animated talking doll. U.S. Pat. No. 4,665,640 to Forsse et al discloses an electromechanical controller for an animated character having facial movements and sounds produced in synchronism with control signals. U.S. Pat. No. 4,775,352 to Curran et al discloses an animated talking doll having movable eye and mouth parts controlled by geared electric motors through flexible driven links controlled by signals from a replaceable tape cartridge. U.S. Pat. No. 4,805,328 to Mirahem discloses a talking doll utilizing an electro mechanical drive mechanism and having lip movements responsive to an audio drive signal with an on-off characteristic based on thresholding the audio signal. Also, U.S. Pat. No. 4,808,142 to Berliner discloses an actuated doll having lips mechanically movable to simulate speech and including a speech synthesizing system. However, it has been found that these prior art animated characters having face mechanisms and control system circuits for animated characters all have various undesired deficiencies, so that some improvements have been sought.

SUMMARY OF INVENTION

This invention provides an animated character including a stationary support structure having an upper body member and a face unit mounted directly therein, and having a face unit mechanism mounted on a face member of the upper body member of the animated character. The face unit is operable by a integrated control and sound system also mounted in the support structure, with the face unit mechanism being operable in synchronism with movements of eye and mouth elements of the face unit.

The face unit mechanism includes a gear case containing a first electric motor arranged for driving a rotatable drum through a belt and gear train, the rotatable drum having a helical shaped outer cam surface arranged for moving a reciprocal bar element mounted in the case, which bar is attached to and can move two eyeballs pivotally mounted in the face member. A second electric motor drives a geared rotor which moves a reciprocal linkage element attached to a pivotable lower lip of the face member, so as to move the pivotable lip element up and down. Rotation of the geared rotor is resisted by a spring, having one end attached to the geared rotor, so that when the second electric motor is activated, the mouth lower lip element is lowered and opened. When the second motor is inactivated, the lip element will be raised and closed by force of the spring, which is preferably a coiled or helical type spring exerting a torsional force on the rotor. The spring resistance to rotation of the geared rotor can be adjusted by a spring holder to which the spring other end is attached.

Operation of the eyeball and lip elements of the face member will occur in synchronism with singing or speaking sounds produced by the control and sound system mounted in the support structure lower portion, with the sounds being emitted from a speaker also mounted in the support structure of the activated character. The first and second electric motors are powered from an electrical source which is preferably dry cell batteries controlled by an on-off switch located in the support structure lower portion The integrated control and sound system for the animated character of this invention mixes a high frequency audio signal with a low frequency control signal which are recorded and then extracted to energize the two electric motors and the speaker, all synchronized with movements of the eye and mouth of the face unit of the animated character.

This invention advantageously provides an animated character, such as an animated advertising sign or singing tree structure, which character utilizes a face member and a face unit mechanism which provides realistic eye and mouth movements in synchronism with singing or speaking sounds emitted by a speaker, and controlled by a control circuit means.

BRIEF DESCRIPTION OF DRAWINGS

This invention will be described further with reference to the following drawings, in which.

DESCRIPTION OF INVENTION

Figure 2:
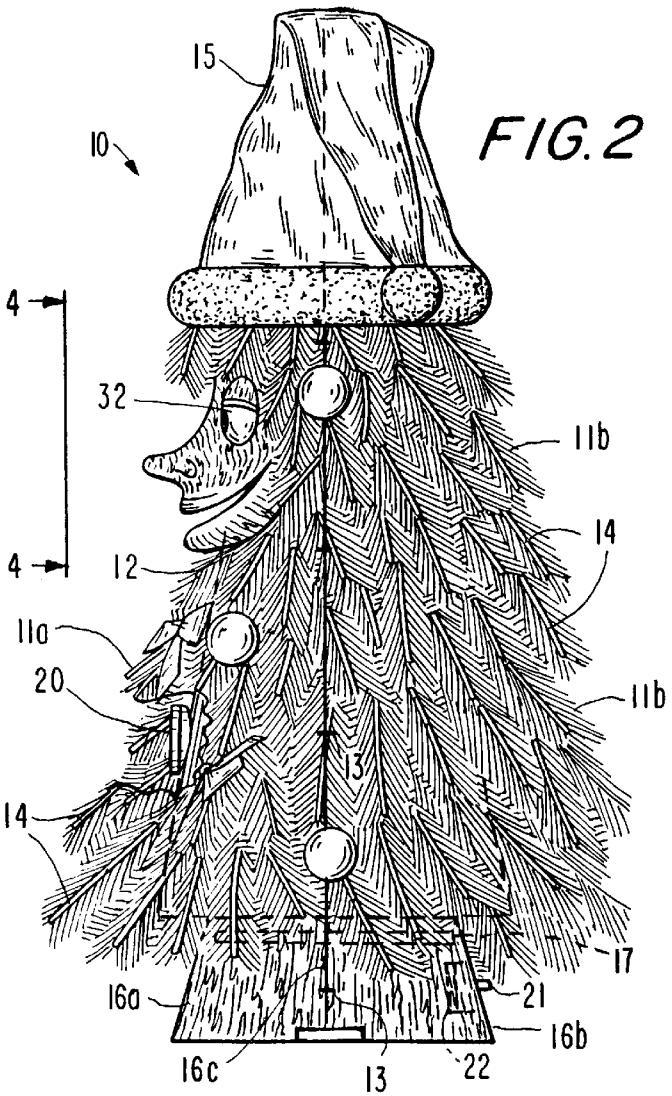
FIG. 2 is a side elevational view taken at line 2—2 of FIG. 1.
Figure 1:
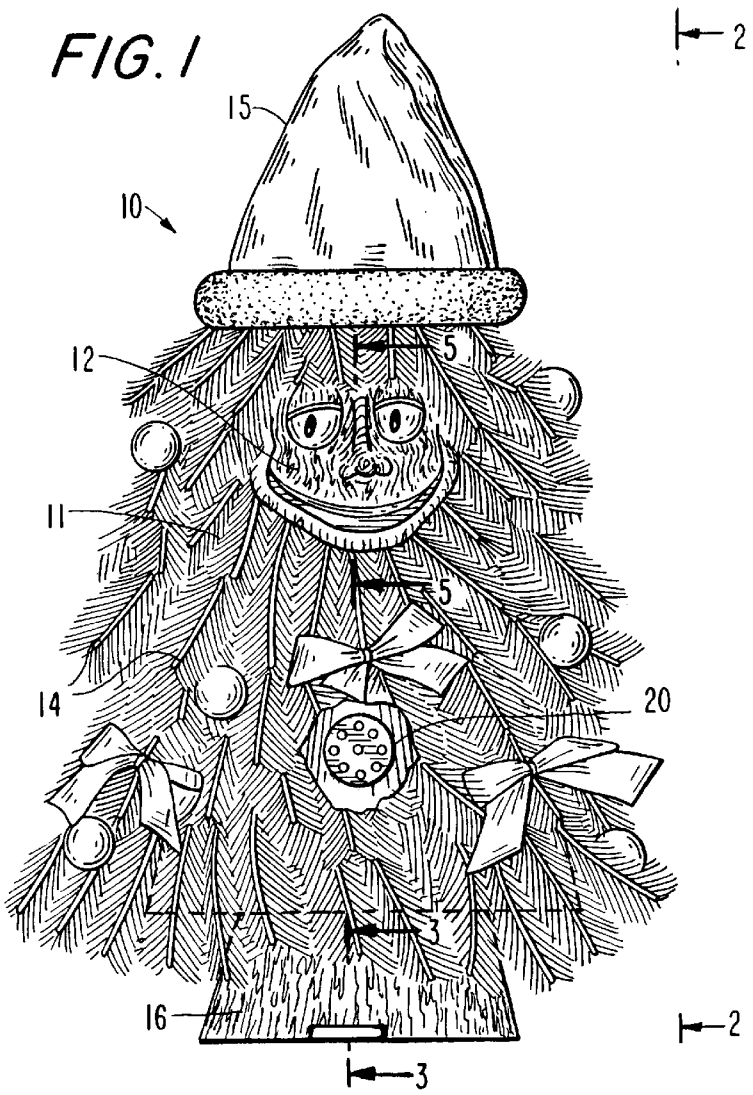
FIG. 1 is a front elevational view of an animated character in the form of an evergreen singing tree, including a support structure and a face unit having movable eyes and lip elements incorporated into the tree upper portion.

As shown by FIG. 1, an animated character 10 includes a stationary support structure having an upper body member 11, and a face unit 12 which is rigidly mounted in the front portion of the body member 11. As shown by FIG. 2, the stationary body member 11 includes a front portion 11*a* and a rear portion 11*b* which are attached together along a mating joint 11*c* by suitable fastener means, such as multiple spaced-apart threaded screws 13. The stationary body member 11 can have various shapes as desired to represent various animated characters and can be covered or dressed as desired so as to have a particular appearance, such as by being covered with multiple artificial tree limbs 14 so as to simulate a singing tree having an animated face unit 12 mounted therein. A suitable cap or other desired covering 15 can be provided at the upper end of the stationary body member 11 above the face unit 12.

Figure 3:
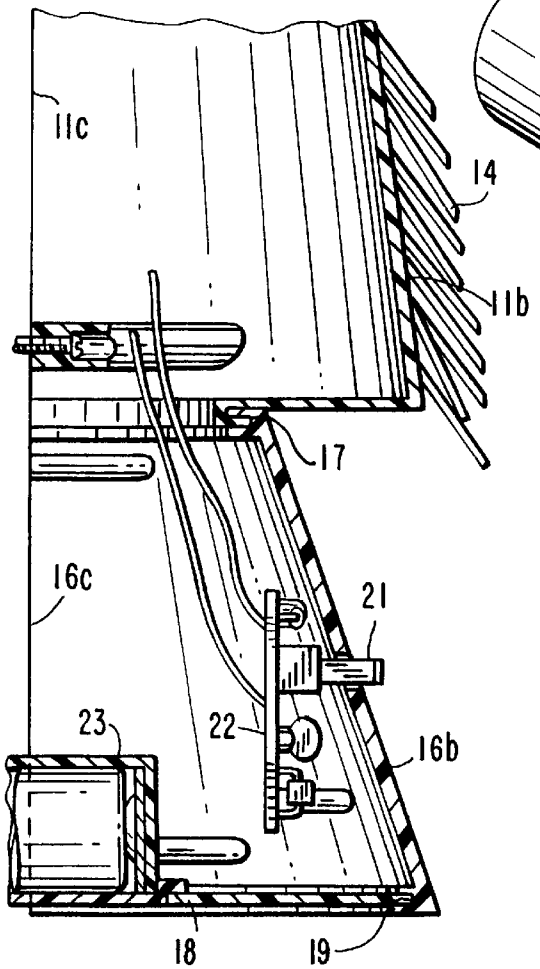
FIG. 3 is an enlarged partial cross-sectional view of the lower portion of the support structure of FIG. 2 taken along lines 3—3 of FIG. 1.

The stationary body members 11*a* and 11*b* are attached to a lower support structure member 16. The support structure 16 includes a front half portion 16*a* and a rear half portion 16*b* attached together at mating joint 16*c* also by multiple fasteners, such as threaded screws 13. As shown by FIG. 3, the upper end of the lower support structure 16 is attached onto the lower end of the body member 11 by an intermitting upper mechanical joint 17. A plate 18 attached to the support structure 16 at interfitting lower joint 19 closes the lower end of the support structure 16.

A speaker element 20 is mounted in the front side 11*a* of the stationary body member 11, and a control circuit unit 22 is mounted onto the rear portion 16*b* of the support structure 16. The face unit 12 and speaker element 20 are both operated by an electrical switch 21 attached to the lower support member 16. An electric source such as from batteries 24 is provided in an enclosure 23 in the support structure 16 to operate the control circuit unit 22 and the speaker 20.

Figure 5:
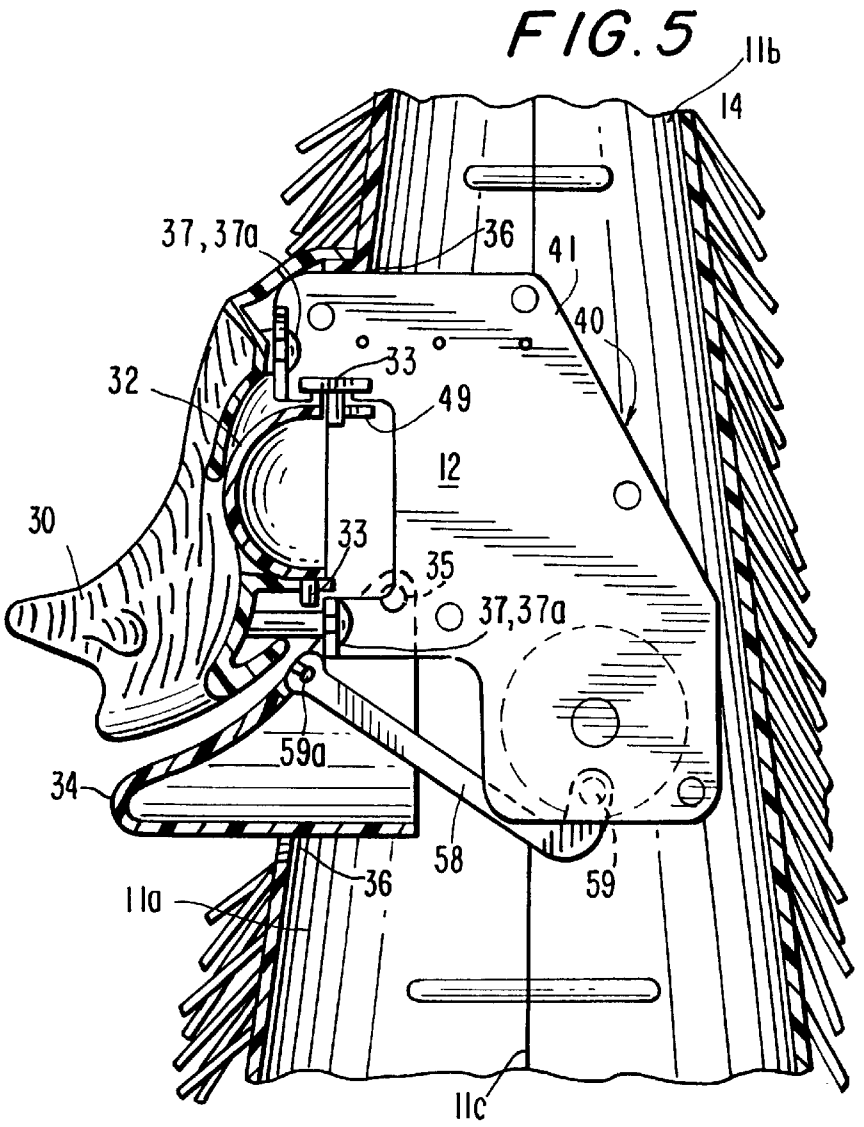
FIG. 5 is an enlarged cross-sectional view of the face unit of FIG. 1 taken along lines 5—5 of FIG. 1.
Figure 4:
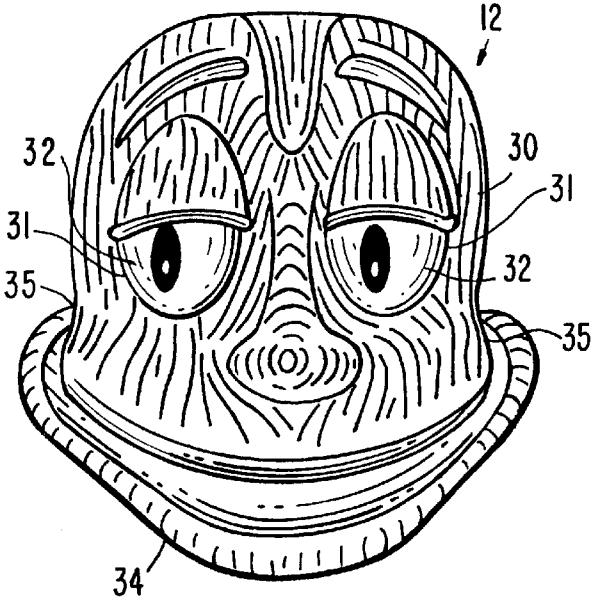
FIG. 4 shows a front view of the face unit taken at line 4—4 of FIG. 2 and having two pivotable eyeballs and a movable lower lip element.

The face unit 12 is shown in greater detail by FIGS. 4 and 5. The face unit 12 includes a front face member 30 having a shape suitable to represent any particular desired character, such as a singing elf in an evergreen tree. The face member 30 has two openings 31 each sized for receiving a spherical shaped eyeball element 32 pivotably mounted at dual vertical pins 33 in the face member. A lower elongated lip element 34 is pivotally attached at each of its ends to the face member 30 by dual horizontal pivot pins 35. As shown by FIG. 5, the face unit 12 is fixedly mounted in an opening 36 provided in the front portion 11*a* of body member 11 by suitable fastening means such as brackets 37 multiple screws 37*a*. The two pivotable eyeball elements 32 and the lower pivotable lip 34 are moved by a face unit mechanism 40 in synchrony with sounds emitted by the speaker element 20 and controlled by the control and sound generating system unit 22.

Figure 6:
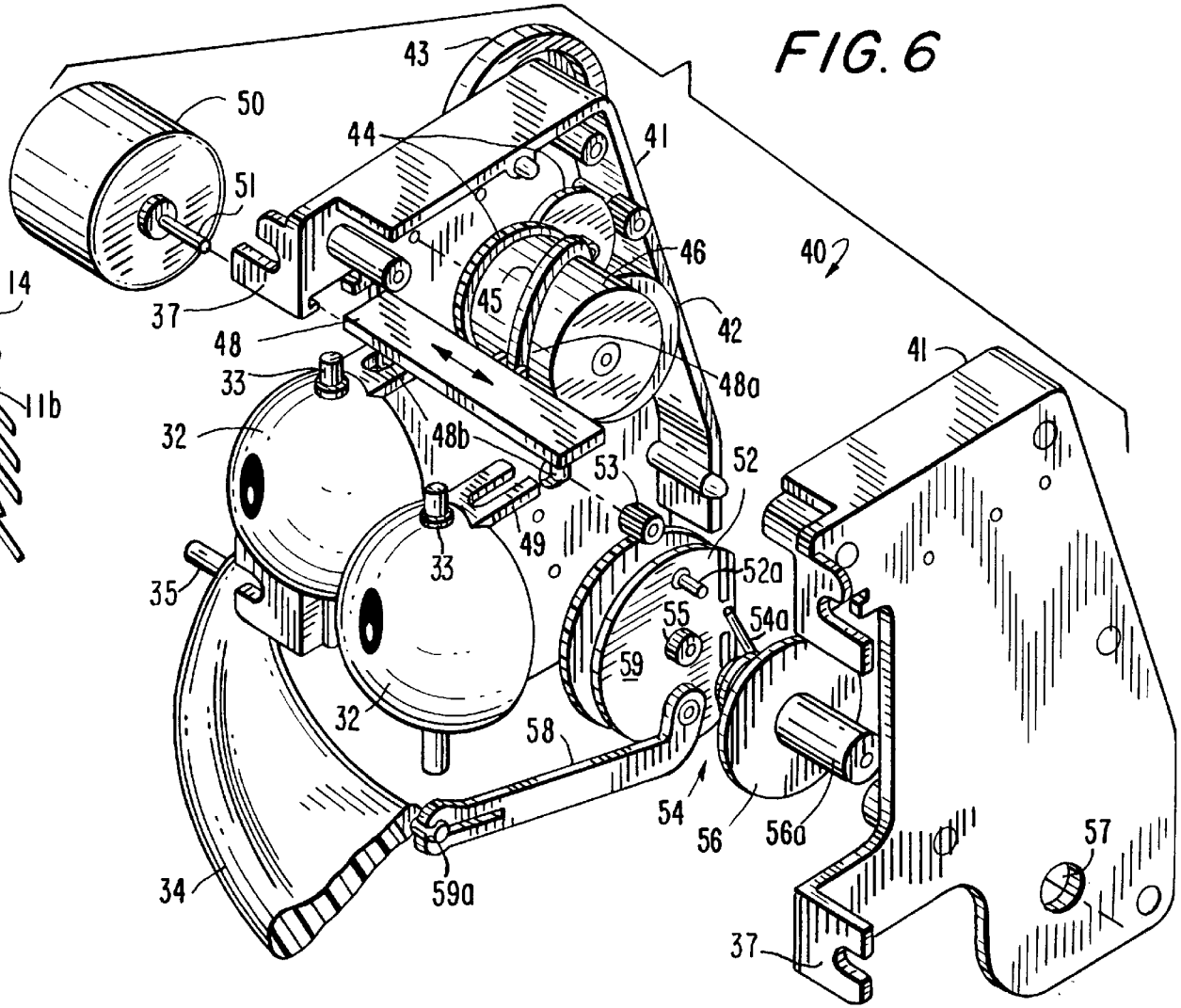
FIG. 6 is an exploded perspective view of a face unit mechanism of FIG. 5 and which is mounted directly on the face member for actuating the two pivotable eyeballs and lower lip elements of the face unit.

The elements of the face unit mechanism 40 for operating the face unit 12 is fixedly mounted directly and entirely onto the member 30 and located in the stationary upright body member and are 11*a* shown in an exploded view by FIG. 6. A gear case 41 supports two electric motors and their gear drives arranged so as to drive separately the eyeballs 32 to pivot them from side to side, and also drive the lower lip 34 of the mouth so as to simulate a singing or speaking action. Regarding the pivoted action of the eyeballs 32, a first electric motor 42 and belt drive system 43 and gears 44 drives a rotatable cylindrical-shaped drum 46. The drum has a raised helical-shaped cam 45 provided on the drum outer surface which contacts a central slot 48*a* of an elongated reciprocable bar 48, so as to cause the bar 48 to be moved horizontally from left to right repeatedly in a reciprocating motion. The bar 48 has two lower protrusions 48*b* which each connect with a slotted bracket 49 attached to each eyeball 32, so that the reciprocating action of the bar 48 will pivot the eyeballs 32 horizontally in the face member 30.

Regarding the action of the mouth lower lip 34 in the face member 30, a second electric motor 50 is supported by the gear case 41 and drives a shaft 51 and geared rotor 52 rotated through pinion gear 53 whenever electric power is connected to the second motor 50. Rotation of the geared rotor 52 and its central extension spindle 55 is resisted by a coiled torsional spring 54, which is coiled around the spindle 55 so that spring prong 54*a* contacts rotor pin 52*a* and reverses rotation of geared rotor 52 whenever there is no electric power input to the motor 50. The reverse rotational force on the geared rotor 52 can be adjusted by an adjustable spring holder 56, which includes an elongated stem 56*a* and can be turned from outside the case 41 through hole 57 by a suitable tool (not shown) to set the desired torsional strength of the coil spring 54. A link 58 is pivotably attached at geared rotor 59 to the its rearward end by a pin 52 and is attached at its forward end to the lower lip element 34 by a pin 59*a,* so as to cause the pivoted lower lip 34 of the mouth to move up and down. When no electric power is provided to the second motor 50, the force of the coiled spring 54 will keep the pivoted lower lip 34 of the mouth closed. The mouth lower lip 34 will be opened whenever an electric signal is provided to motor 50. The signal which is inputted to this face mechanism 40 is related to the sound signal to speaker 20 provided by the control circuit unit 22, so that the action of the mouth lower lip 34 will match the sound so as to produce a realistic singing or speaking effect for the mouth of the face unit 12.

Figure 7:
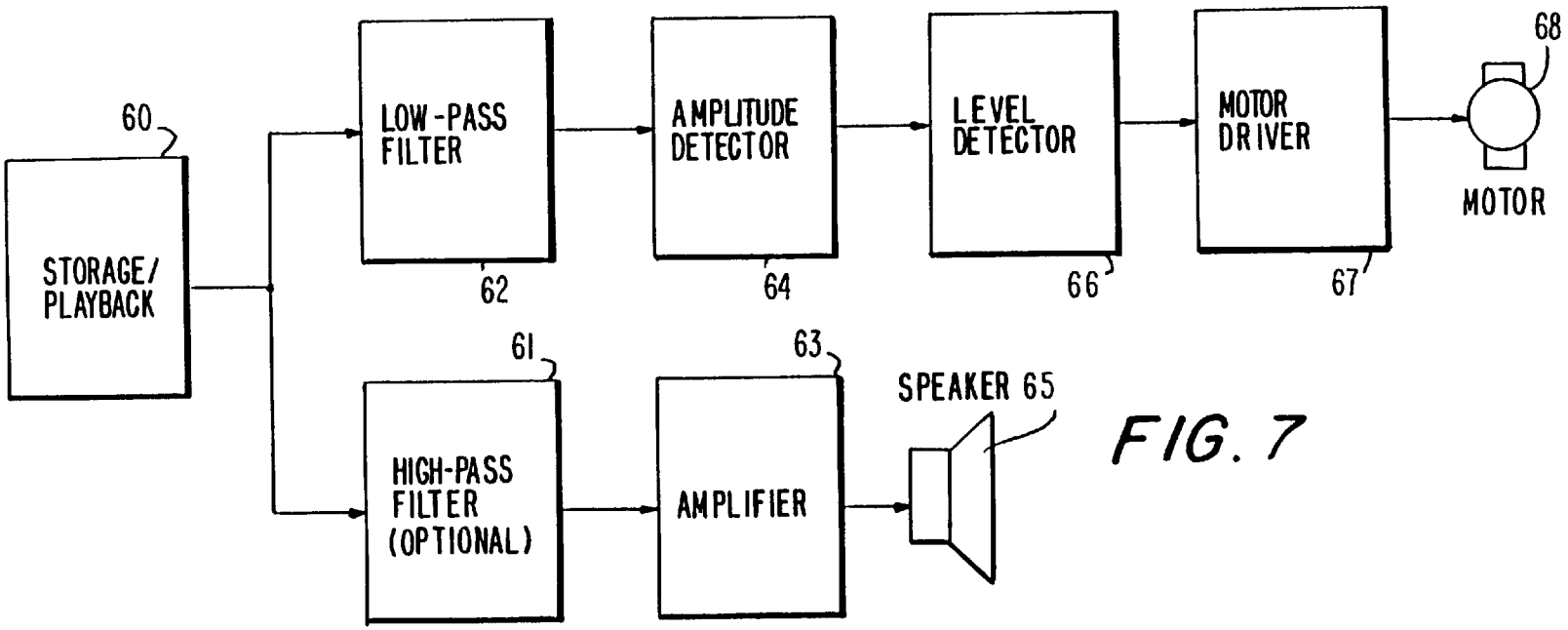
FIG. 7 is a block diagram of the signal control system utilized in the invention.
Figure 8:
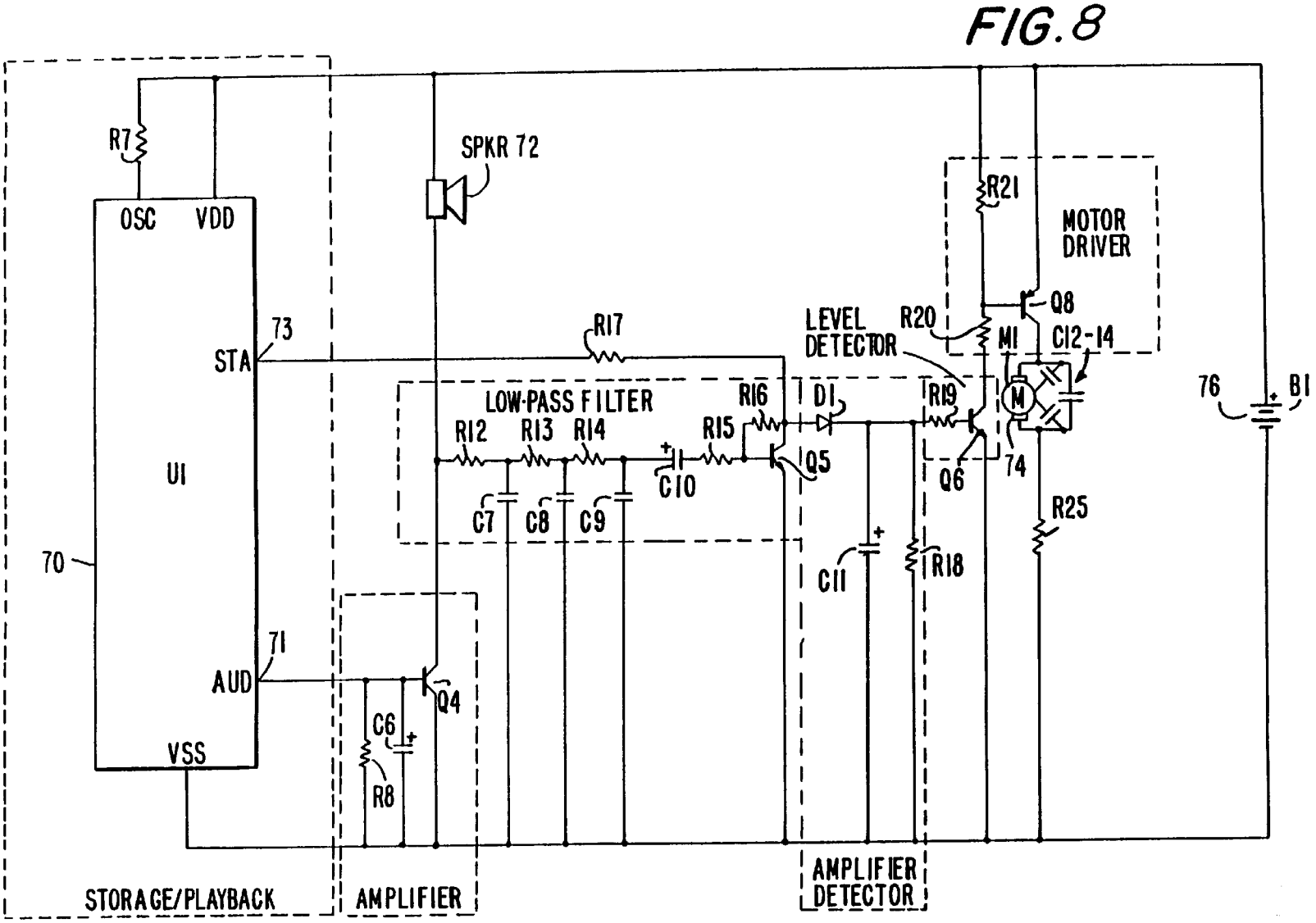
FIG. 8 is a schematic diagram of the electrical control circuits for operating the face unit mechanism and speaker of the animated character.

As shown in the FIG. 7 block diagram and FIG. 8 schematic control circuit diagram, an AC control signal from the control unit 22 of the animated character 10 is mixed with an audio signal soundtrack during a prerecording step, and then the signal is extracted from the recording means and used to energize the speaker 20 and the two electric motors 42 and 50, which activate the movable eye and mouth elements in the face unit 12 of the animated character. For the control circuit unit 22, the control signal can have a frequency either significantly higher but is preferably lower than that of the audio signal intended to be heard by a user of the animated character 10.

Referring now to FIG. 7, the mixed audio control signal stored in the control unit 22 is extracted from the storage medium 60 and applied to each of two filters which separate the combined signal into its high audio and low control frequency components. The high-pass filter 61 in the mixed signal chain and amplifier 63 leads to a speaker 65, and removes the low frequency control signal from the high frequency audio signal intended to be heard by a user. If the control signal's frequency is outside the range of audibility or the range of reproduction, this high pass filter 61 can be eliminated as necessary for the control system. In the preferred embodiment, the low frequency control signal at about 40 Hz frequency is not readily reproduced by the speaker 65 and is essentially inaudible even without use of the high-pass filter 61.

In the control signal chain leading to an electrically-actuated motor 68, the low-pass filter 62 removes the audio signal and passes only the low-frequency control signal. The signal from the low-pass filter 62 is applied to the amplitude detector 64 which typically takes the form of a rectifier which derives a DC voltage proportional to the amplitude of the AC low frequency control signal applied to it. This signal is applied to the level detector 66 which senses whether the amplitude of the amplitude detector's output exceeds a fixed threshold, in which case it activates the motor driver 67, which applies sufficient electric power to activate the motor 28.

If the level detector 66 has a large amount of gain (i.e. it has a sharp transfer function), the electric motor 68 will be either fully on or fully off. If the level detector 68 has less gain (a more linear transfer function) the power applied to the motor 68 will be proportional to the output of the amplitude detector 64, which may be desirable for some installations.

It should be noted that some of the blocks shown in FIGS. 7 can be arranged or combined without substantially altering the functions performed, e.g. the high-pass filter 61 can be placed after the amplifier 63 instead of before it, if such rearrangement would facilitate design efficiency for a specific control signal installation. Also, the signal storage/playback means 60 can be either a magnetic tape or a digital memory circuit device.

A schematic diagram of a preferred digital memory circuit embodiment is shown by FIG. 8. An integrated circuit U1 at 70 is a commonly available "Voice IC" containing all necessary circuitry and memory for storage and playback of signals in the approximate frequency range of 0 Hz to 6 k Hz. Resistor R7 controls the frequency of U1's internal clock circuit. On activation of the integrated circuit U1, the stored mixed audio control signals output are in the form of a current from U1's AUD pin at 71. This current is converted to a voltage by resistor R8, as is standard practice in the use of this type of IC. Capacitor C6 removes unwanted residual clock feedthrough from the signal, also common practice. Transistor Q4 amplifies the audio signal to a power level capable of driving the speaker (SPKR) 72 which produces the sound heard by the user. Because the small speaker used in this memory circuit is incapable of reproducing the 40 Hz control signal, the high-pass filter 61 shown in the FIG. 7 block diagram has been omitted in the interest of reduced cost.

Resistors R12, R13 and R14 and capacitors C7, C8 and C9 form a conventional 3-pole low-pass filter. It should be noted that in this circuit the input to the low pass filter 62 is taken from the output of the amplifier, rather than directly from the output of the storage/playback device 60 as is shown in the FIG. 7 block diagram. This rearrangement of the signal processing blocks is made possible by the omission of the high pass filter 61 (the control signal has not been filtered out of the amplifier's output signal) and provides a larger (amplified) signal for the extraction circuitry to work with.

Capacitor C10, resistors R15–R17, and transistor Q5 perform buffering of the low-pass filter 62 output and provide amplification of the resulting extracted control signal in order to provide a larger signal for the amplitude detector. This amplifier could be considered part of the low pass filter or part of the amplitude detector, and is not conceptually part of the invention, hence it is not shown separately on the FIG. 7 block diagram.

It may be noted that resistor R17 is not connected directly to the power supply voltage as would be customary, and it is connected instead to the STA output 73 of U1 70. The STA 73 is a control output provided by the playback IC which can be programmed in software to perform arbitrary control functions. In this embodiment, STA 73 is used to disable the amplitude detector during the start of playback of a sound, at which time the playback IC produces an unwanted transient which otherwise would erroneously activate the motor.

Diode D1, capacitor C11, and resistor R18 form the amplitude detector 64 of FIG. 7, and are connected in a well-known configuration known as a "peak detector", which is essentially a half-wave rectifier. Resistor R19 and transistor Q6 act as the level detector 66, and together with resistors R20, R21, and transistor Q8, form the motor driver 67 of FIG. 7. When the output of the amplitude detector 64 is large enough to source sufficient current into the base of Q6, then Q6 begins to conduct, turning on the transistor Q8, which supplies current to the motor M1 at 74. In this embodiment, the transistor Q6 acting as a level detector 66 does not have a very sharp transfer curve, and the amount of current delivered to the motor M1 at 74 is somewhat proportional to the voltage at the output of the amplitude detector 64. This has been found to provide greater subtlety of mouth movement for an animated character than a level detector which turns on fully as soon as the amplitude detector's output exceeds a fixed threshold.

Capacitors C12–C14 provide suppression of electrical noise generated by the motor 74, and resistor R25 limits the maximum current which is delivered to the motor battery B1 at 76 supplies power to the system.

This control circuit unit 22 is described in greater detail in co-pending patent application entitled, System and Method for Embedding and Extracting Control Signals for an Electrically-Actuated Device, Ser. No. 08/801,207, filed Feb. 18, 1997, which is incorporated herein by reference to the extent necessary to provide an adequate disclosure of the electrical control system of this invention.

Although this invention has been described broadly and also as a specific embodiment, it will be understood that modifications and variations can be made within the scope as defined by the following claims.

We claim:

1. An animated character having facial movements synchronized with singing or speaking sounds provided by the character, the character comprising:

a shaped vertically oriented support structure having an upper body member and a lower support member;

a face unit fixedly mounted in the upper body member front portion of said support structure, said face unit including a face member having two pivoted eyeball elements and a mouth having a lower lip element pivotably attached to the face member, said eyeball and lip elements being made movable by an electrically actuated face unit mechanism mounted directly and entirely onto the face member; said face unit mechanism including a gear case containing a first electric motor having a shaft attached to a rotatable drum having a helical-shaped cam which contacts a reciprocal bar element connected to said two pivoted eyeball elements and arranged for pivotably moving the eyeball elements horizontally said face unit mechanism gear case also containing a second electric motor driving a geared rotor and which is attached to a rotatably adjustable spring holder which includes a torsional spring element said geared rotor being pivotably attached to a linkage element arranged for pivotably moving the lower lip element upward and downward;

a speaker means mounted in said support structure upper body member below the face unit;

a control circuit unit mounted in said support structure and adapted for generating electrical audio and control signals and producing singing and speaking sounds in synchronism with movements of the eyeball and lip elements of the face member; and an electric power source and switch provided to said support structure to activate the face unit mechanism and actuate movements of the face member eyeballs and lip element in synchronism with singing and speaking sounds produced by the control circuit unit of the animated character; whereby the face unit mechanism is operable by the electric power source and the control circuit unit for pivotably moving the eyeball elements horizontally and lip element upward and downward intermittently in synchronism with sounds from the speaker means of the animated character.

2. The animated character of claim 1, wherein said support structure upper body member includes a front portion and a rear portion attached together by fastener means, with said face unit being fixedly mounted in an opening in the support structure upper body member front portion; said geared rotor being rotatable connected to said adjustable spring holder and its torsional spring element for intermittently reversing rotation of the geared rotor and provide a reciprocating motion for the lower lip element.

3. The animated character of claim 1, wherein said control circuit unit and electric power source are mounted in the support member lower portion.

4. The animated character of claim 1, wherein said power source is provided by at least one dry-cell battery provided within an enclosure and an on-off switch located in the support structure lower member.

5. The animated character of claim 1, wherein the support structure upper body member is covered with artificial tree branches, and the face member is shaped to simulate a singing evergreen tree having its upper end covered by a cap.

6. An animated character having facial eye and mouth movements synchronized with singing or speaking sounds produced from the character, the character comprising:

a shaped vertically oriented support structure having an upper body member and a lower support member, said body member being covered with artificial evergreen branches to simulate a tree;

a face unit fixedly mounted in the upper body member front portion of said support structure, said face unit including a face member having two pivoted eyeball elements and a mouth having a lower lip element pivotably attached to the face member, said eyeball and lip elements being made movable by an electrically actuated face unit mechanism mounted directly onto the face member;

a speaker means mounted in said support structure upper body member below the face unit;

a control circuit unit mounted in said support structure lower support member and adapted for generating electrical audio and control signals and producing singing and speaking sounds in synchronism with movements of the eyeball and lip elements of the face member;

a battery electric power source and switch provided in said lower support member to activate the face unit mechanism and actuate movements of the face member eyeball and lip elements in synchronism with singing and speaking sounds produced by the control circuit unit;

said face unit mechanism including a first electric motor mounted in a case and adapted for actuating movements of the two pivoted eyeball elements, a second electric motor mounted in said case and having a rotatable shaft attached to a geared rotor;

a linkage element having one end pivotally attached to the geared rotor and having the linkage element other end pivotably attached to the lower lip element of the mouth of said face member; and an adjustable spring holder and spring element mounted on a central extension spindle attached to said geared rotor so as to resist rotation of the geared rotor, whereby whenever each said first and second electric motor is activated the two eyeball elements can be pivoted horizontally back and forth and the mouth lower lip element can be moved upward and downward in synchronism with singing and speaking sounds produced by the control circuit unit so as to simulate a singing or speaking action for the face member of the animated character.

7. A face unit adapted for mounting in an animated character, the face unit comprising:

a shaped face member including two eyeball elements each pivotally mounted in the face member upper portion, said eyeball elements each being connected to an elongated bar element which is transversely movable by a cam surface attached to a rotatable drum provided in a case mounted directly onto the face member, and a mouth having a lower lip element pivotally mounted in the face member;

a first electric motor mounted in said case and having a rotatable shaft operably attached to the rotatable drum;

a second electric motor mounted in said case and having a rotatable shaft attached to a geared rotor;

a linkage element having one end pivotally attached to the geared rotor and having the linkage element other end pivotably attached to the lower lip element of the mouth of said face member; and an adjustable spring holder and spring element mounted on a spindle centrally attached to said geared rotor so as to resist rotation of the rotor, whereby whenever each said first and second electric motor is activated, the two eyeball elements can be pivoted horizontally back and forth and the mouth lower lip element can be pivotally moved upward and downward so as to simulate a singing or speaking action for the face member of the face unit.

8. The face unit of claim 7, wherein said case mounted onto the face member encloses said spring holder and geared rotor and said spring element.

9. The face unit of claim 7, wherein said rotatable drum cam surface has a helical shape and contacts said elongated bar element so as to transversely move the bar element and pivotally move the two eyeball elements.

10. The face unit of claim 7, wherein said spring element is a coiled torsion spring provided around said geared rotor central spindle and the spring torsion force is made externally adjustable by the adjustable spring holder attached to the spindle.

11. A face unit adapted for mounting in an animated character, the face unit comprising:

a shaped face member including two eyeball elements each pivotally mounted in the face member upper portion, said eyeball elements each being connected to an elongated bar element which is transversely movable by a helical-shaped cam surface attached to a rotatable drum provided in a case mounted directly onto the face member, and a mouth having a lower lip element pivotally mounted in the face member;

a first electric motor mounted in said case and having a rotatable shaft operably attached to the rotatable drum;

a second electric motor mounted in said case and having a rotatable shaft attached to a geared rotor;

a linkage element having one end pivotally attached to the geared rotor and having the linkage element other end pivotably attached to the lower lip element of the mouth of said face member; and an adjustable spring holder and spring element mounted on a rotatable spindle centrally attached to said geared rotor so as to resist rotation of the rotor, whereby whenever each said first and second electric motor is activated, the two eyeball elements are pivoted horizontally back and forth by said movable elongated bar element and the mouth lower lip element is pivotally moved upward and downward so as to simulate a singing or speaking action for the face member of the face unit.

* * * * *